United States Patent [19]

Sernovitz

[11] 4,317,303

[45] Mar. 2, 1982

[54] ILLUMINATED DISPLAY DEVICE

[75] Inventor: Morton A. Sernovitz, Skokie, Ill.

[73] Assignee: Market Products, Inc., Skokie, Ill.

[21] Appl. No.: 235,147

[22] Filed: Feb. 17, 1981

[51] Int. Cl.[3] ..... G09F 13/04

[52] U.S. Cl. ..... 40/564; 40/152.1

[58] Field of Search ..... 40/564, 152.2, 576, 40/5, 10 R

[56] References Cited

U.S. PATENT DOCUMENTS

| | | | |
|---|---|---|---|
| 2,306,511 | 12/1942 | Wagner | 40/576 |
| 3,824,726 | 7/1974 | Schubert | 40/576 |
| 3,997,991 | 12/1976 | Haman-Chaffey et al. | 40/564 |
| 4,005,538 | 2/1977 | Tung | 40/564 |
| 4,271,408 | 6/1981 | Teshima et al. | 40/564 |

*Primary Examiner*—Gene Mancene

*Assistant Examiner*—Wenceslao J. Contreras

*Attorney, Agent, or Firm*—Dithmar, Stotland, Stratman & Levy

[57] ABSTRACT

An illuminated display device includes a molded housing receiving therein a circuit board having light elements thereon projecting forwardly therefrom, the housing being closed by a transparent front cover. Embossments on the housing and the front cover cooperate firmly to position the circuit board therebetween in the housing. The cover also has forwardly projecting embossments defining recesses to accommodate the light elements. A display sheet may be disposed in the housing in front of the circuit board and/or an indicia holder may be mounted on the obverse surface of the cover. Support means are provided for mounting the housing in a display orientation.

9 Claims, 5 Drawing Figures

ILLUMINATED DISPLAY DEVICE

BACKGROUND OF THE INVENTION

The present invention relates to display devices and, in particular, to an illuminated display device such as a price tag for use on display racks, shelving or the like for retail merchandise.

Illuminated display devices are disclosed, for example, in U.S. Pat. No. 1,190,600 issued July 11, 1916, and U.S. Pat. No. 4,096,656 issued June 27, 1978. But these prior devices are fundamentally large and expensive and are not suited for use as price tags or the like.

SUMMARY OF THE INVENTION

It is a general object of the present invention to provide an improved illuminated display device which avoids disadvantages of prior art devices while affording additional operating and structural features.

It is an important object of this invention to provide a small illuminated display device of simple, economical and lightweight construction which is suitable for use as a price tag or the like.

It is another object of this invention to provide a display device of the character described which provides a substantially sealed construction for protecting the illumination means from contamination or damage.

Still another object of this invention is the provision of a display device of the type set forth, which is characterized by ease and simplicity of use, permitting ready replacement of display indicia.

These and other objects of the invention are attained by providing an illuminated display device comprising an open-front housing having a rear wall and a peripheral side wall structure, the rear wall having first projections thereon extending forwardly therefrom, a circuit board disposed within the housing in engagement with the first projections, electric illumination means carried by the circuit board on the obverse side thereof and adapted to be connected to an associated source of electric power, a transparent cover mountable on the housing for closing the open front thereof while permitting visibility of the illumination means, the cover having second projections thereon extending rearwardly therefrom for cooperation with the first projections firmly to position the circuit board therebetween in the housing when the cover is mounted thereon, and means carried by the housing for supporting it in a display orientation.

The invention consists of these and other novel features and a combination of parts hereinafter fully described, illustrated in the accompanying drawings, and particularly pointed out in the appended claims, it being understood that various changes in the details may be made without departing from the spirit, or sacrificing any of the advantages, of the invention.

DESCRIPTION OF THE PREFERRED EMBODIMENT

Figure 1:
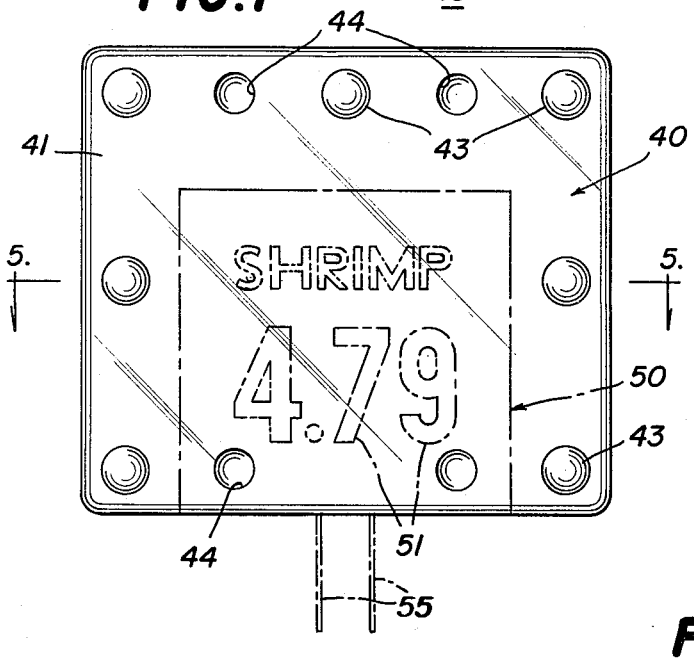
FIG. 1 is a front elevational view of a display device constructed in accordance with and embodying the features of the present invention.
Figure 2:
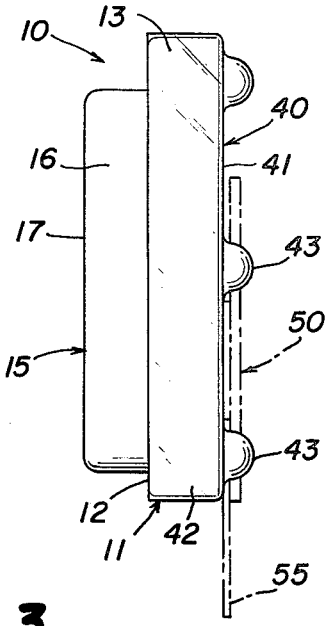
FIG. 2 is a side elevational view of the display device of FIG. 1, as viewed from the left-hand side thereof.
Figure 3:
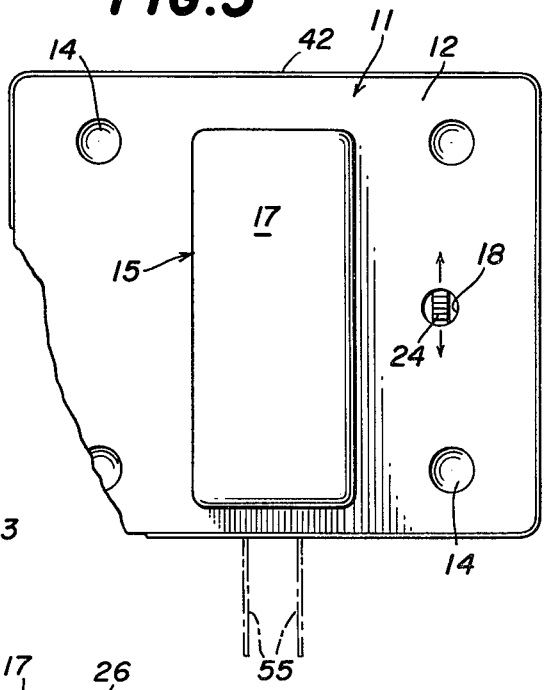
FIG. 3 is a fragmentary rear elevational view of the display device of FIG. 1.
Figure 4:
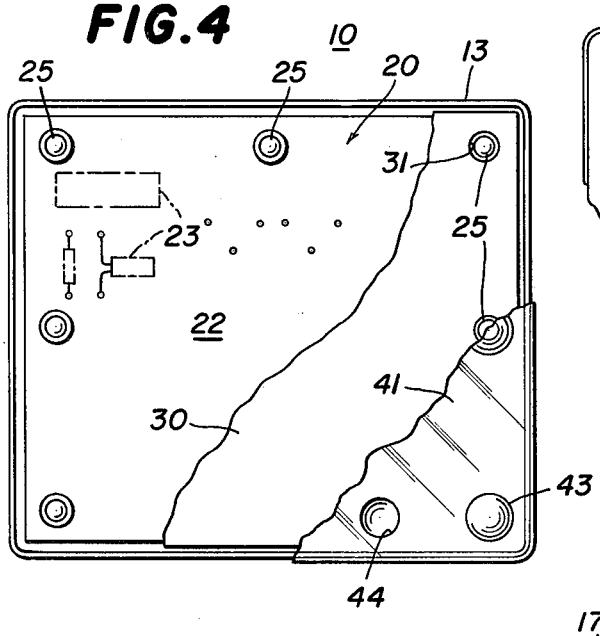
FIG. 4 is a view similar to FIG. 1, with portions of the cover and color display panel broken away more clearly to show the arrangement of the circuit board.
Figure 5:
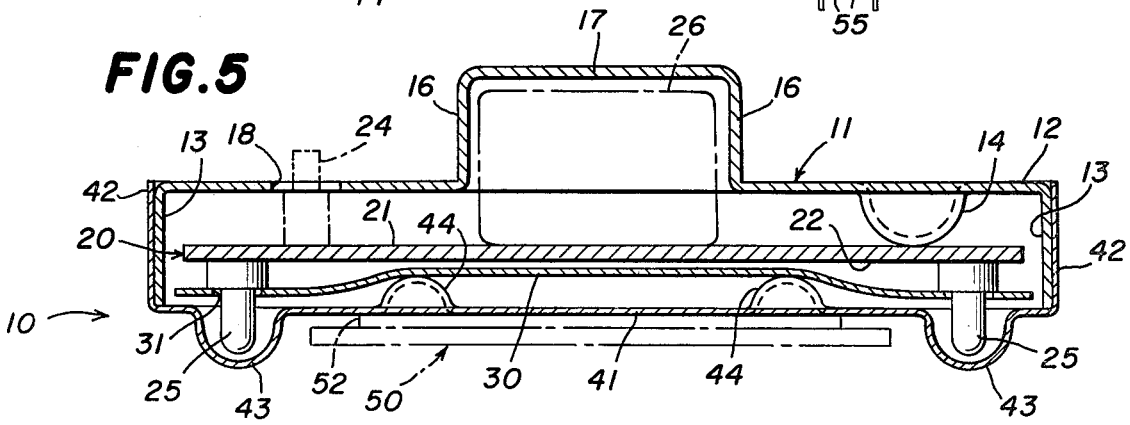
FIG. 5 is an enlarged view in horizontal section taken along the line 5—5 in FIG. 1.

Referring now more particularly to the drawings, there is illustrated a display device, generally designated by the numeral 10, constructed in accordance with and embodying the features of the present invention. The display device 10 includes a housing 11 of unitary one-piece construction which includes a flat, rectangular rear wall 12, the side edges of which are respectively integral with side walls 13 which project forwardly from the rear wall 12 substantially normal thereto. Also formed in the rear wall 12 are a plurality of spaced-apart forwardly-extending embossments or projections 14. Formed in the rear wall 12 and projecting rearwardly therefrom is a battery compartment, generally designated by the numeral 15, defined by four side walls 16 which extend rearwardly from the rear wall 12 substantially normal thereto and are interconnected by a flat, rectangular end wall 17 substantially parallel to the rear wall 12. Also formed in the rear wall 12 is a switch opening 18.

Disposed within the housing 11 is a flat, rectangular circuit board, generally designated by the numeral 20, which has a flat, planar rear surface 21, which may have electrical conductors printed thereon and which is disposed in engagement with the projections 14, and a flat, planar front surface 22 which has a plurality of electronic circuit components 23 mounted thereon, all in a well-known manner. Also carried by the circuit board 20 is a switch 24 which projects rearwardly therefrom through the switch opening 18 in the housing 11. A plurality of light elements 25 are mounted on the front surface 22 of the circuit board 20 at spaced-apart points along the perimeter thereof. The light elements 25 may be any suitable light source, but are preferably low-voltage lamps which produce negligible heat output. The circuit components 23 may include timing circuitry for blinking the light elements 25 on and off. There may also be mounted on the circuit board 20 terminals (not shown) for a battery 26 which is adapted to be disposed in the battery compartment 15. Alternatively, the light elements 25 and the associated electrical circuitry on the circuit board 20 may be AC-powered, in which case a suitable power cord and transformer (not shown) may be provided. The circuitry may be connected to and disconnected from the associated power source by means of the switch 24.

There may also be disposed within the housing 11 a rectangular display panel 30, which overlies the circuit board 20 and has a plurality of holes 31 therein for respectively accommodating therethrough the light elements 25. The display panel 30 may be appropriately colored to provide an attractive background for the indicia of the display device 10 and, if desired, may have indicia imprinted directly thereon in a display area bounded by the light elements 25. Alternatively, indicia means (not shown) may be attached to this area of the front surface of the display panel 30.

The housing 11 is closed by a cover, generally designated by the numeral 40, which is preferably of unitary one-piece construction and is formed of transparent material such as plastic or the like, the cover 40 having a rectangular front wall 41 integral at the side edges thereof respectively with side walls 42 which extend rearwardly from the front wall 41 substantially normal thereto. The cover 40 is dimensioned to fit over the housing 11 with the side walls 42 respectively overlying the side walls 13 in surrounding telescopic relationship therewith. Formed in the front wall 41 are forwardly projecting embossments 43 which define recesses for respectively accommodating the light elements 25 therein when the cover 40 is mounted in place on the housing 41. Also formed in the front wall 41 are a plurality of spacedapart rearwardly-extending projections or embossments 44 which cooperate with the embossments 14 on the housing rear wall 12 for firmly positioning therebetween the circuit board 20 and the display panel 30, effectively to prevent rattling of the circuit board 20 and display panel 30 within the housing 11. It will be appreciated that because of the transparent nature of the cover 40, the light elements 25 and the display panel 30 are clearly visible therethrough.

There may also be provided an indicia tag, generally designated by the numeral 50, which may have indicia 51 imprinted or mounted on the obverse face thereof and may carry on the reverse face thereof a suitable attachment means such as double-sided tape 52 for attaching the indicia tag 50 to the outer surface of the front wall 41 of the cover 40 in the area thereof bounded by the embossments 43. There may be associated with the indicia tag 50, or with the housing 11, a pair of tines 55 adapted for insertion into material such as meat, produce or the like for mounting the display device 10 in a display orientation. It will be appreciated that alternative supporting means may be provided, such as adhesive mounting means on the rear of the housing 11, easel means, hanging means and the like.

In operation, the cover 40 is dimensioned and arranged to fit snugly over the housing 11 effectively to seal the circuit board 20 and the display panel 30 therein, and protect them from damage and contamination, while permitting ready access to the interior of the housing 11 for replacement of the display panel 30 or the mounting or demounting of indicia means thereon. The housing 11 and the cover 40 are preferably molded of plastic or the like, the housing 11 preferably being opaque. The display panel 30 may be formed of cardboard, plastic or the like, and is also preferably opaque to conceal the circuit board 20.

From the foregoing, it can be seen that there has been provided an improved illuminated display device which is of simple and economical construction and is suitable for use as a price tag or the like.

I claim:

1. An illuminated display device comprising an open-front housing having a rear wall and a peripheral side wall structure, said rear wall having first projections thereon extending forwardly therefrom, a circuit board disposed within said housing in engagement with said first projections, electric illumination means carried by said circuit board and adapted to be connected to an associated source of electric power, a transparent cover mountable on said housing for closing the open front thereof while permitting visibility of said illumination means, said cover having second projections thereon extending rearwardly therefrom for cooperation with said first projections firmly to position said circuit board therebetween in said housing when said cover is mounted thereon, and means carried by said housing for supporting it in a display orientation.

2. The display device of claim 1, wherein said illumination means projects forwardly from said circuit board, said cover having recesses therein for accommodating said illumination means when said cover is mounted on said housing.

3. The display device of claim 1, wherein said illumination means includes a plurality of light elements spaced apart along the perimeter of said circuit board and bounding a display area thereon.

4. The display device of claim 3, and further including indicia-carrying means mountable on said cover in a position overlying the display area of said circuit board.

5. The display device of claim 1, and further including a display panel disposable within said housing between said circuit board and said cover.

6. The display device of claim 5, wherein said illumination means project forwardly from said circuit board, said display panel having openings therein for receiving said illumination means therethrough.

7. The display device of claim 1, wherein said means for supporting said housing includes a pair of tines adapted for insertion into an associated support.

8. The display device of claim 1, wherein said illumination means is battery-powered, said housing having a recess formed therein for accommodating an associated battery.

9. The display device of claim 1, wherein said cover includes a front wall and an encompassing peripheral side wall structure adapted to be received over said side wall structure of said housing in surrounding telescopic relationship therewith.

* * * * *